US007740536B2

(12) United States Patent
Pederson et al.

(10) Patent No.: US 7,740,536 B2
(45) Date of Patent: Jun. 22, 2010

(54) GAMING DEVICE HAVING PLAYER SELECTION OF SCATTER PAY SYMBOL POSITIONS

(75) Inventors: Mark W. Pederson, Reno, NV (US); Jody N. Slater, Reno, NV (US); Brian D. Swift, Sparks, NV (US)

(73) Assignee: IGT, Reno, NV (US)

( * ) Notice: Subject to any disclaimer, the term of this patent is extended or adjusted under 35 U.S.C. 154(b) by 1133 days.

(21) Appl. No.: 10/952,589

(22) Filed: Sep. 29, 2004

(65) Prior Publication Data

US 2006/0084493 A1 Apr. 20, 2006

(51) Int. Cl.
*A63F 9/24* (2006.01)

(52) U.S. Cl. ..... 463/20; 463/16; 273/143 R

(58) Field of Classification Search ..... 463/20, 463/16, 25, 39–42; 273/143 R, 138.1, 292, 273/139; 705/37; 710/7
See application file for complete search history.

(56) References Cited

U.S. PATENT DOCUMENTS

| | | | |
|---|---|---|---|
| 4,157,829 | A | 6/1979 | Goldman et al. |
| 4,198,052 | A | 4/1980 | Gauselmann |
| 4,335,809 | A | 6/1982 | Wain |
| 4,339,798 | A | 7/1982 | Hedges et al. |
| 4,448,419 | A | 5/1984 | Telnaes |
| 4,467,424 | A | 8/1984 | Hedges et al. |
| 4,494,197 | A | 1/1985 | Troy et al. |
| 4,582,324 | A | 4/1986 | Koza et al. |
| 4,618,150 | A | 10/1986 | Kimura |
| 4,624,459 | A | 11/1986 | Kaufman |
| 4,652,998 | A | 3/1987 | Koza et al. |
| 4,669,730 | A | 6/1987 | Small |
| 4,689,742 | A | 8/1987 | Troy et al. |
| 4,695,053 | A | 9/1987 | Vazquez, Jr. et al. |
| 4,732,386 | A | 3/1988 | Rayfiel |
| 4,756,531 | A | 7/1988 | DiRe et al. |

(Continued)

FOREIGN PATENT DOCUMENTS

| | | |
|---|---|---|
| AU | 200129848 | 9/2001 |

(Continued)

OTHER PUBLICATIONS

Bingo Advertisement written by Casino Data System, published in 1998.

(Continued)

*Primary Examiner*—Peter DungBa Vo
*Assistant Examiner*—Masud Ahmed
(74) *Attorney, Agent, or Firm*—K&L Gates LLP

(57) ABSTRACT

A gaming device with a scatter pay formed by enabling a player to pick a plurality of symbol display areas. The symbols generated to be displayed in the picked symbol display areas of the scatter pay are evaluated by the gaming device for a winning combination. In one embodiment, whether an award is associated with a combination of symbols generated in the picked symbol display areas of the scatter pay is based on a separate scatter pay paytable. In one embodiment, the player is enabled to pick a predetermined number of symbol display areas upon the generation of a triggering symbol. Alternatively, the player is enabled to pick the symbol display areas to be included in a scatter pay based on making a wager of a predetermined amount.

29 Claims, 19 Drawing Sheets

U.S. PATENT DOCUMENTS

| | | | | |
|---|---|---|---|---|
| 4,805,907 | A | 2/1989 | Hagiwara | |
| 4,815,741 | A | 3/1989 | Small | |
| 4,817,951 | A | 4/1989 | Crouch et al. | |
| 4,838,552 | A | 6/1989 | Hagiwara | |
| 4,842,278 | A | 6/1989 | Markowicz | |
| 4,856,787 | A | 8/1989 | Itkis | |
| 4,982,337 | A | 1/1991 | Burr et al. | |
| 5,042,809 | A | 8/1991 | Richardson | |
| 5,085,436 | A | 2/1992 | Bennett | |
| 5,092,598 | A | 3/1992 | Kamille | |
| 5,158,293 | A | 10/1992 | Mullins | |
| 5,209,479 | A | 5/1993 | Nagao et al. | |
| 5,265,874 | A | 11/1993 | Dickinson et al. | |
| 5,276,312 | A | 1/1994 | McCarthy | |
| 5,282,620 | A | 2/1994 | Keesee | |
| 5,324,035 | A | 6/1994 | Morris et al. | |
| 5,344,144 | A | 9/1994 | Canon | |
| 5,393,061 | A | 2/1995 | Manship et al. | |
| 5,398,932 | A | 3/1995 | Eberhardt et al. | |
| 5,407,199 | A | 4/1995 | Gumina | |
| 5,423,539 | A | 6/1995 | Nagao | |
| 5,449,173 | A | 9/1995 | Thomas et al. | |
| 5,542,669 | A | 8/1996 | Charron et al. | |
| 5,580,053 | A | 12/1996 | Crouch | |
| 5,580,055 | A | 12/1996 | Hagiwara | |
| 5,611,535 | A | 3/1997 | Tiberio | |
| 5,628,684 | A | 5/1997 | Bouedec | |
| 5,630,754 | A | 5/1997 | Rebane | |
| 5,674,128 | A | 10/1997 | Holch et al. | |
| 5,722,891 | A | 3/1998 | Inoue | |
| 5,769,716 | A | 6/1998 | Saffari et al. | |
| 5,772,509 | A | 6/1998 | Weiss | |
| 5,779,545 | A | 7/1998 | Berg et al. | |
| 5,788,573 | A | 8/1998 | Baerlocher et al. | |
| 5,800,269 | A | 9/1998 | Holch et al. | |
| 5,823,874 | A | 10/1998 | Adams | |
| 5,833,536 | A | 11/1998 | Davids et al. | |
| 5,833,537 | A | 11/1998 | Barrie | |
| 5,848,932 | A | 12/1998 | Adams | |
| 5,851,148 | A | 12/1998 | Brune et al. | |
| 5,871,398 | A | 2/1999 | Schneier et al. | |
| 5,882,261 | A | 3/1999 | Adams | |
| 5,902,184 | A | 5/1999 | Bennett et al. | |
| 5,919,088 | A | 7/1999 | Weiss | |
| 5,927,714 | A | 7/1999 | Kaplan | |
| 5,944,606 | A | 8/1999 | Gerow | |
| 5,947,820 | A | 9/1999 | Morro et al. | |
| 5,949,042 | A | 9/1999 | Dietz, II et al. | |
| 5,951,397 | A | 9/1999 | Dickinson | |
| 5,954,582 | A | 9/1999 | Zach | |
| 5,980,384 | A | 11/1999 | Barrie | |
| 5,984,781 | A | 11/1999 | Sunaga | |
| 5,997,401 | A | 12/1999 | Crawford | |
| 6,001,016 | A | 12/1999 | Walker et al. | |
| 6,004,207 | A | 12/1999 | Wilson, Jr. et al. | |
| 6,015,346 | A | 1/2000 | Bennett | |
| 6,017,032 | A | 1/2000 | Grippo et al. | |
| 6,024,640 | A | 2/2000 | Walker et al. | |
| 6,033,307 | A | 3/2000 | Vancura | |
| 6,056,642 | A | 5/2000 | Bennett | |
| 6,089,976 | A * | 7/2000 | Schneider et al. | 463/16 |
| 6,089,977 | A | 7/2000 | Bennett | |
| 6,089,982 | A | 7/2000 | Holch et al. | |
| 6,093,102 | A | 7/2000 | Bennett | |
| 6,102,798 | A | 8/2000 | Bennett | |
| 6,113,098 | A | 9/2000 | Adams | |
| 6,120,031 | A | 9/2000 | Adams | |
| 6,120,378 | A | 9/2000 | Moody | |
| 6,126,542 | A | 10/2000 | Fier | |
| 6,132,311 | A | 10/2000 | Williams | |
| 6,146,271 | A | 11/2000 | Kadlic | |
| 6,146,272 | A | 11/2000 | Walker et al. | |
| 6,146,273 | A | 11/2000 | Olsen | |
| 6,149,521 | A | 11/2000 | Sanduski | |
| 6,155,925 | A | 12/2000 | Giobbi et al. | |
| 6,159,095 | A | 12/2000 | Frohm et al. | |
| 6,159,097 | A | 12/2000 | Gura | |
| 6,159,098 | A | 12/2000 | Slomiany et al. | |
| 6,165,070 | A | 12/2000 | Nolte et al. | |
| 6,168,520 | B1 | 1/2001 | Baerlocher et al. | |
| 6,168,521 | B1 | 1/2001 | Luciano et al. | |
| 6,174,233 | B1 | 1/2001 | Sunaga et al. | |
| 6,183,361 | B1 | 2/2001 | Cummings et al. | |
| 6,190,254 | B1 | 2/2001 | Bennett | |
| 6,190,255 | B1 | 2/2001 | Thomas et al. | |
| 6,200,217 | B1 | 3/2001 | Osawa | |
| 6,203,430 | B1 | 3/2001 | Walker et al. | |
| 6,210,275 | B1 | 4/2001 | Olsen | |
| 6,210,276 | B1 | 4/2001 | Mullins | |
| 6,217,448 | B1 | 4/2001 | Olsen | |
| 6,220,959 | B1 * | 4/2001 | Holmes et al. | 463/13 |
| 6,220,961 | B1 | 4/2001 | Keane et al. | |
| 6,227,971 | B1 | 5/2001 | Weiss | |
| 6,241,606 | B1 | 6/2001 | Riendeau et al. | |
| 6,251,013 | B1 | 6/2001 | Bennett | |
| 6,254,480 | B1 | 7/2001 | Zach | |
| 6,261,177 | B1 | 7/2001 | Bennett | |
| 6,261,178 | B1 | 7/2001 | Bennett | |
| 6,270,412 | B1 | 8/2001 | Crawford et al. | |
| 6,273,820 | B1 | 8/2001 | Haste, III | |
| 6,280,328 | B1 | 8/2001 | Holch et al. | |
| 6,293,866 | B1 | 9/2001 | Walker et al. | |
| 6,309,298 | B1 | 10/2001 | Gerow | |
| 6,309,300 | B1 | 10/2001 | Glavich | |
| 6,315,660 | B1 | 11/2001 | DeMar et al. | |
| 6,315,664 | B1 | 11/2001 | Baerlocher et al. | |
| 6,319,124 | B1 | 11/2001 | Baerlocher et al. | |
| 6,325,716 | B1 | 12/2001 | Walker | |
| 6,346,043 | B1 | 2/2002 | Colin et al. | |
| 6,347,996 | B1 | 2/2002 | Gilmore et al. | |
| 6,358,147 | B1 | 3/2002 | Jaffe et al. | |
| 6,358,151 | B1 | 3/2002 | Enzminger et al. | |
| 6,364,314 | B1 | 4/2002 | Canterbury | |
| 6,368,218 | B2 | 4/2002 | Angell, Jr. | |
| 6,402,614 | B1 | 6/2002 | Schneier et al. | |
| 6,413,161 | B1 * | 7/2002 | Baerlocher et al. | 463/20 |
| 6,413,162 | B1 | 7/2002 | Baerlocher et al. | |
| 6,419,583 | B1 | 7/2002 | Crumby et al. | |
| 6,425,824 | B1 | 7/2002 | Baerlocher et al. | |
| 6,439,993 | B1 | 8/2002 | O'Halloran | |
| 6,450,885 | B2 | 9/2002 | Schneier et al. | |
| 6,454,648 | B1 | 9/2002 | Kelly et al. | |
| RE37,885 | E | 10/2002 | Acres et al. | |
| 6,461,241 | B1 | 10/2002 | Webb et al. | |
| 6,464,581 | B1 | 10/2002 | Yoseloff et al. | |
| 6,471,208 | B2 | 10/2002 | Yoseloff et al. | |
| 6,475,086 | B2 | 11/2002 | Zach | |
| 6,491,584 | B2 | 12/2002 | Graham et al. | |
| 6,494,454 | B2 | 12/2002 | Adams | |
| 6,508,711 | B1 | 1/2003 | Ono | |
| 6,517,432 | B1 | 2/2003 | Jaffe | |
| 6,524,184 | B1 | 2/2003 | Lind et al. | |
| 6,527,638 | B1 | 3/2003 | Walker et al. | |
| 6,533,664 | B1 | 3/2003 | Crumby | |
| 6,537,150 | B1 | 3/2003 | Luciano et al. | |
| 6,551,187 | B1 | 4/2003 | Jaffe | |
| 6,558,254 | B2 | 5/2003 | Baelocher et al. | |
| 6,599,187 | B2 | 7/2003 | Gerow | |
| 6,602,137 | B2 | 8/2003 | Kaminkow et al. | |
| 6,604,740 | B1 * | 8/2003 | Singer et al. | 273/292 |
| 6,607,439 | B2 | 8/2003 | Schneier et al. | |
| 6,609,971 | B2 | 8/2003 | Vancura | |
| 6,609,974 | B2 | 8/2003 | Mead et al. | |
| 6,619,660 | B2 | 9/2003 | Schaefer et al. | |

| | | | | |
|---|---|---|---|---|
| 6,634,941 | B2 | 10/2003 | Olive | |
| 6,641,477 | B1 * | 11/2003 | Dietz, II | 463/20 |
| 6,648,758 | B2 | 11/2003 | Bennett | |
| 6,676,126 | B1 | 1/2004 | Walker et al. | |
| 6,685,562 | B1 | 2/2004 | Rantanen | |
| 6,695,695 | B2 | 2/2004 | Angel | |
| 6,722,982 | B2 * | 4/2004 | Kaminkow et al. | 463/25 |
| 6,729,621 | B2 | 5/2004 | Moody | |
| 6,729,961 | B1 | 5/2004 | Millerschone | |
| 6,733,385 | B1 | 5/2004 | Enzminger et al. | |
| 6,749,500 | B1 | 6/2004 | Nelson et al. | |
| 6,780,107 | B2 * | 8/2004 | Baerlocher et al. | 463/16 |
| 6,877,745 | B1 | 4/2005 | Walker et al. | |
| 6,966,833 | B2 * | 11/2005 | Kaminkow et al. | 463/16 |
| 6,986,710 | B2 * | 1/2006 | Baerlocher et al. | 463/16 |
| 7,040,985 | B2 * | 5/2006 | Vancura | 463/20 |
| 7,387,570 | B2 | 6/2008 | Randall | |
| 2001/0054794 | A1 | 12/2001 | Cole et al. | |
| 2002/0010013 | A1 | 1/2002 | Walker et al. | |
| 2002/0025844 | A1 | 2/2002 | Casey et al. | |
| 2002/0039920 | A1 | 4/2002 | Bryant | |
| 2002/0098882 | A1 | 7/2002 | Lind et al. | |
| 2002/0098883 | A1 | 7/2002 | Packes, Jr. et al. | |
| 2002/0196342 | A1 | 12/2002 | Walker et al. | |
| 2003/0027626 | A1 | 2/2003 | Marks et al. | |
| 2003/0045345 | A1 | 3/2003 | Berman | |
| 2003/0060257 | A1 | 3/2003 | Katz et al. | |
| 2003/0060261 | A1 | 3/2003 | Katz et al. | |
| 2003/0060276 | A1 | 3/2003 | Walker et al. | |
| 2003/0069056 | A1 | 4/2003 | Cormack et al. | |
| 2003/0083120 | A1 | 5/2003 | DeWall et al. | |
| 2003/0190943 | A1 | 10/2003 | Walker et al. | |
| 2003/0224850 | A1 | 12/2003 | Anderson et al. | |
| 2004/0023714 | A1 * | 2/2004 | Asdale | 463/22 |
| 2004/0036212 | A1 | 2/2004 | Walker et al. | |
| 2004/0038723 | A1 | 2/2004 | Schneier et al. | |
| 2004/0082378 | A1 * | 4/2004 | Peterson et al. | 463/20 |
| 2004/0092299 | A1 | 5/2004 | Gauselmann | |
| 2005/0020351 | A1 * | 1/2005 | Baerlocher et al. | 463/20 |

FOREIGN PATENT DOCUMENTS

| | | | |
|---|---|---|---|
| AU | 200157973 | | 2/2002 |
| EP | 0 238 289 | A3 | 9/1987 |
| EP | 0 945 837 | A2 | 9/1999 |
| EP | 0 984 408 | A2 | 3/2000 |
| EP | 1150261 | | 10/2001 |
| GB | 2 226 907 | A | 7/1990 |
| GB | 2 328 311 | A | 2/1999 |
| GB | 2 393 019 | A | 3/2004 |
| WO | WO 01/15055 | | 3/2001 |
| WO | WO 01/19476 | | 3/2001 |
| WO | WO 02/077935 | | 10/2002 |
| WO | WO 02/102484 | | 12/2002 |
| WO | WO 03/049055 | A2 | 3/2003 |
| WO | WO 03/089084 | | 10/2003 |
| WO | WO 03/089088 | | 10/2003 |
| WO | WO 2005/086018 | | 9/2005 |

OTHER PUBLICATIONS

Black Panther article written by Strictly Slots, published in 2000.
Bumble Bugs advertisement written by Aristocrat, published in Jan. 1997.
Crazy Fruits Advertisement written by Atronic, published in 2000.
Crazy Fruits Article written by Strictly Slots, published in 2001.
Diamonopoly Advertisement by International Gamco, Inc., published 2002.
Electronic Pull Tabs Advertisement by 21st Century Gaming, published prior to 2002.
Enchanted Unicorn—Unicorn Bonus Advertisements written by IGT, published in 2001.
Evil Kneivel Advertisement written by IGT, published in 2001.
Five Card Instant Bingo Advertisement , written by IGT, published in 2000.
Fortune Cookie Advertisement written by IGT, published in 2000.
Instant Winner Advertisement by Williams/WMS Gaming, published prior to 2002.
Laurel and Hardy Advertisement written by Shuffle Master Gaming, published in 2002.
Lucky Times California Lottery Newsletter published 1996.
Lucy article written by Strictly Slots, published in Nov. 2003.
Money Mouse Advertisement written by Aristocrat, published in Feb. 1997.
Money to Burn Advertisement written by WMS Gaming, Inc., published date unknown.
Play it again Advertisement by International Gamco, Inc., published 2000.
Reelin-n-Rockin Advertisement written by Aristocrat, published in 1999.
Regis Cash Club Advertisement written by IGT, published in 2000.
Scatter Magic II Advertisement written by Aristocrat, published in Dec. 2002.
South Park Advertisement written by IGT, published in 2000.
Stooges II Article written by Strictly Slots, published in Jun. 2001.
Texas Tea Advertisement written by IGT, published in 2000.
Wild Cougar Article written by Strictly Slots, published in 2004.

* cited by examiner

FIG. 5A

Scatter PayTable

| | |
|---|---|
| AAA | 500 |
| BBB | 400 |
| CCC | 300 |
| DDD | 200 |
| EEE | 100 |
| FFF | 75 |
| GGG | 50 |
| HHH | 25 |

FIG. 5B

PayTable

| | |
|---|---|
| AAAAA | 1000 |
| BBBBB | 900 |
| CCCCC | 800 |
| DDDDD | 700 |
| EEEEE | 600 |
| FFFFF | 500 |
| GGGGG | 400 |
| HHHHH | 300 |

FIG. 7

Scatter PayTable

| | |
|---|---|
| ABC | 500 |
| DEF | 400 |
| GHI | 300 |
| JKL | 200 |
| MNO | 100 |

GAMING DEVICE HAVING PLAYER SELECTION OF SCATTER PAY SYMBOL POSITIONS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and, more particularly, to a gaming device which enables a player to pick the symbol display areas to be included in a scatter pay.

BACKGROUND OF THE INVENTION

Conventional gaming devices such as slot machines provide a player an award based on combinations of symbols generated along one or more paylines. Traditional paylines include fixed predetermined symbol display areas arranged adjacently along lines which are horizontal, vertical, diagonal and combinations thereof. The player is able to choose which of the predetermined combinations of symbol display areas will be evaluated for winning combinations of symbols generated in those symbol display areas by activating or wagering on one or more of the predetermined paylines. The player activates a payline based on the amount of the wager made by the player.

Another type of payout in slot games is based on a "scatter pay." A scatter pay includes a pay for the occurrence of designated symbols anywhere on the symbol display. Symbols generated on the symbol display are evaluated for winning combinations as if the symbols were generated along a traditional payline of adjacently arranged symbols. The player, however, has no control over traditional scatter pays.

To increase player enjoyment and excitement, it is desirable to provide players with increased player interaction and control of a gaming feature in a slot machine.

SUMMARY OF THE INVENTION

The present invention overcomes the above shortcomings by providing a gaming device which provides players with increased player interaction and control of the scatter pay feature of a game.

In one embodiment, the player is prompted to pick a predetermined number of symbol display areas in any position on the symbol display. The number is preferably at least two symbol display areas. The picked symbol display areas are indicated and remain indicated through a subsequent activation of the symbol generator such as a plurality of reels. Upon subsequent activation of the symbol generator, the symbols generated on, at or in the picked symbol display areas are evaluated for a winning combination. The player is provided an award based on any generation of a winning combination of symbols in the symbol display areas picked by the player.

In one embodiment, the amount of the wager made by the player determines whether the player is provided the opportunity to pick a scatter pay combination of symbol display areas.

In one embodiment, the number of symbol display areas to be picked by the player is based on the amount of the wager made by the player. Alternatively, the number of symbol display areas to be picked by the player is based on the generation of a trigger symbol. In one embodiment the number of symbol display areas to be picked by the player is based on the number of trigger symbols generated on the symbol display. In one embodiment, the number of symbol display areas to be picked by the player is based on the outcome of another game or portion of the game. It should be appreciated that the number of symbol display areas to be picked by the player can be less than or more than the number of symbols required for a winning combination. Accordingly, the number of symbol display areas to be picked by the player can constitute less than or more than one scatter pay.

In one embodiment, the same paytable is employed for all of the paylines. In one embodiment, the symbols which are generated at the player selected symbol display areas are evaluated based on a different paytable than the paytable associated with other paylines in the gaming device.

In one embodiment, the symbols generated and displayed at the player-selected symbol display areas of the scatter pay are evaluated for a winning combination in the order the symbol display areas are picked by the player. It should be appreciated that combinations of the same or different symbols can comprise a winning combination of symbols in the present invention.

It should be appreciated that the scatter pay picked by the player can be one of a plurality of other activated paylines evaluated for winning combinations of generated symbols.

It should also be appreciated that the player selections can apply to more than one game to avoid slowing down play. For instance, the play or selections of the display areas can remain the same until a designated re-selection event such as a player cash-out, a completion of a designated number of plays or a player input of a re-selection request.

It is therefore an advantage of the present invention to provide a gaming device enabling the player to have an enhanced interaction and perceived control of the outcome of a game by enabling the player to pick the symbol display areas to be included in one or more scatter pays.

It is also an advantage of the present invention to provide a gaming device having more opportunities for a player to win, thereby enhancing the enjoyment and excitement of the gaming experience.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIGS. 5A and 5B are diagrams illustrating examples of separate paytables of one embodiment of the gaming device of the present invention.

FIG. 7 is a diagram illustrating an examples of a paytable of one embodiment of the gaming device of the present invention.

DETAILED DESCRIPTION OF THE INVENTION

Figure 1A:
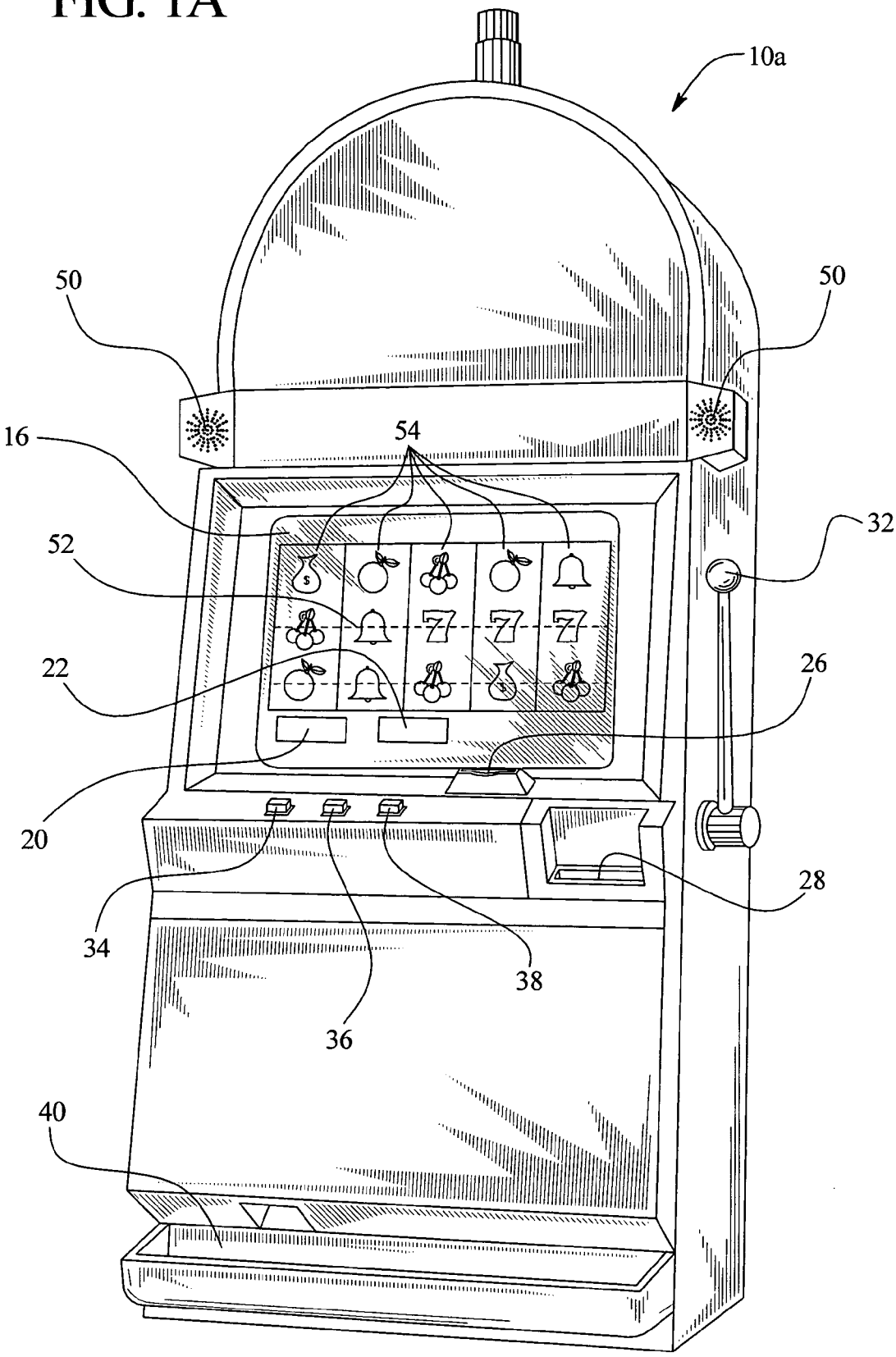
FIG. 1A is a front perspective view of one embodiment of the gaming device of the present invention.
Figure 1B:
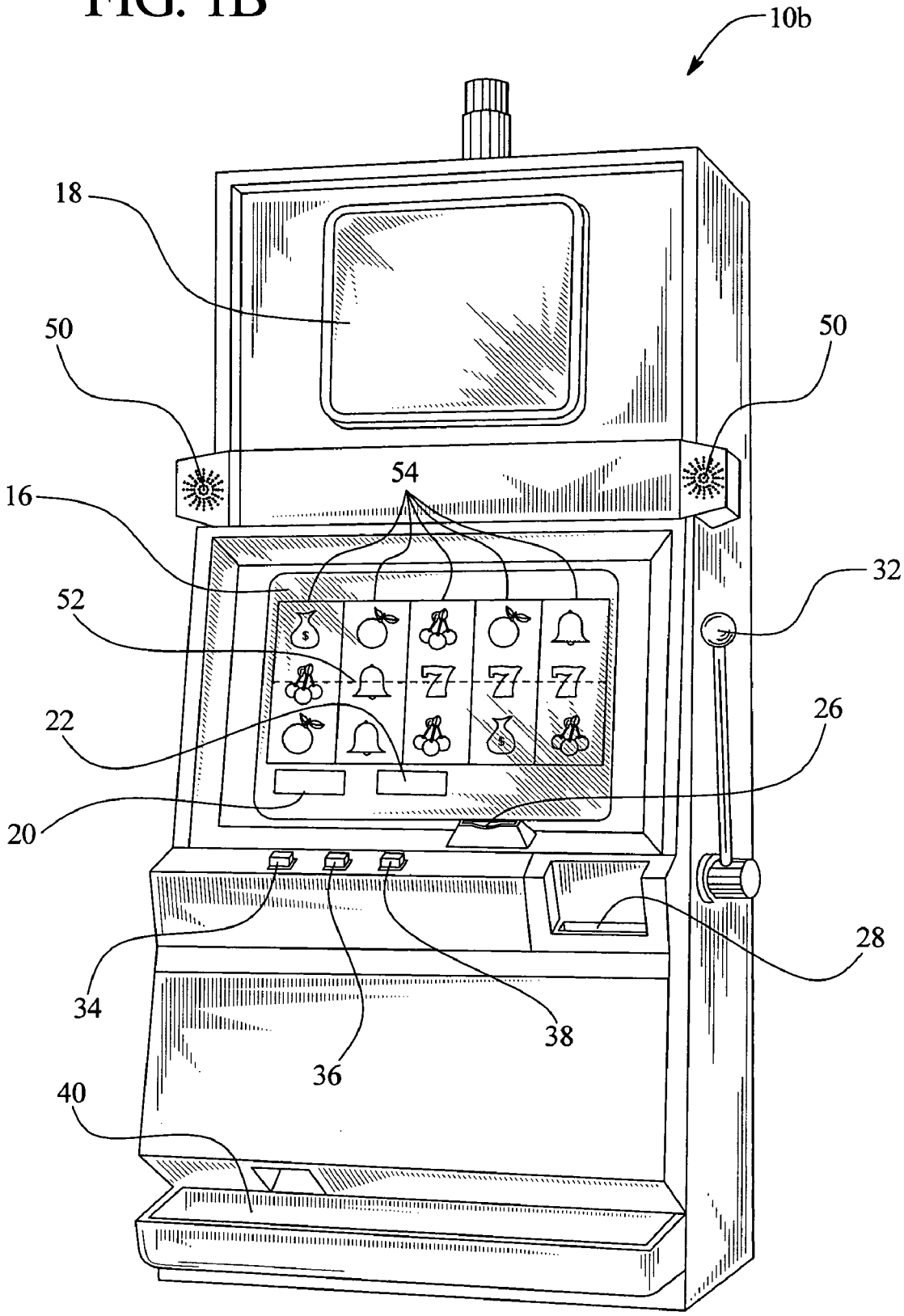
FIG. 1B is a front perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
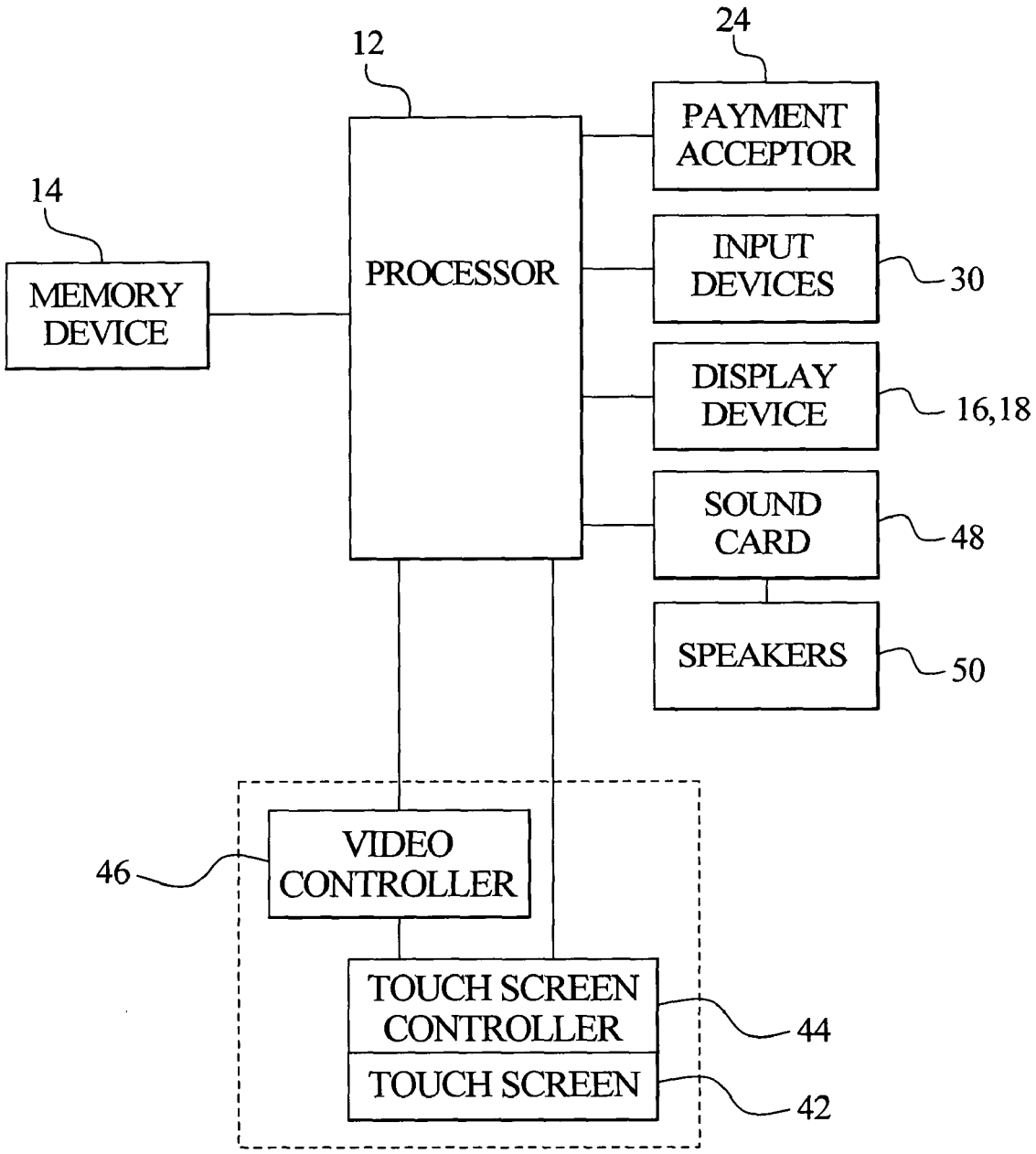
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment where the reels are in a video format, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. As seen in FIGS. 1A and 1B, in one embodiment, gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED) or any other suitable electronic device or display mechanism. In one embodiment, as described in more detail below, the display device includes a touch-screen 42 with an associated touch-screen controller 44. The display devices may be of any suitable configuration, such as a square, rectangle, elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Gaming device 10 can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary or base wagering games may be implemented into the present invention.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device displays at least one and preferably a plurality of reels 54, such as three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, the plurality of simulated video reels 54 are displayed on one or more of the display devices as described above. Each reel 54 displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active pay line or otherwise occur in a winning pattern.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game; he must win or earn entry through play of the primary game and, thus, play of the primary game is encouraged. In another embodiment, qualification of the bonus or secondary game could be accomplished through a simple "buy in" by the player if, for example, the player has been unsuccessful at qualifying through other specified activities.

Figure 2B:
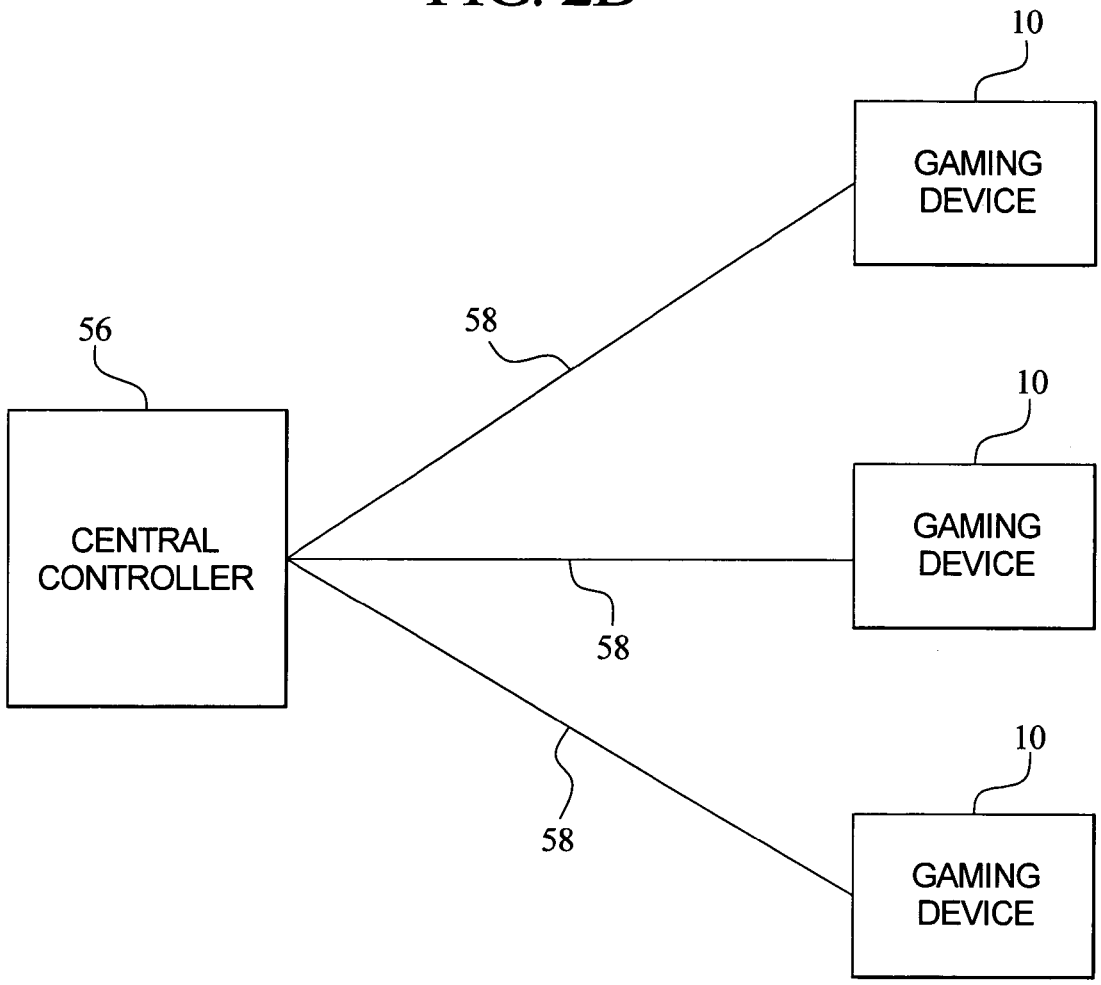
FIG. 2B is a schematic block diagram illustrating a plurality of gaming terminals and communication with a central controller.

In one embodiment, as illustrated in FIG. 2B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller.

In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital signal line (DSL), T-1 line, coaxial cable, fiber optic cable, or other suitable connection. In this embodiment, players may access an Internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

Player-Selectable Scatter Pay Positions

The present invention is related to a gaming device which enables a player to pick symbol display areas to form a scatter pay. The gaming device on at least one subsequent symbol generation evaluates symbols generated in, on or at the symbol display areas of the scatter pay for winning combinations of symbols.

Referring now to FIGS. 3A, 3B, 3C and 3D, in one embodiment of the present invention, the gaming device displays a plurality of symbol display areas on each of a plurality of symbol displays. In the illustrated embodiment, the symbol displays include five reels 54*a*, 54*b*, 54*c*, 54*d* and 54*e*. The symbol display areas on each of the five reels include symbol display areas 100*a*, 100*b*, and 100*c* on reel 54*a*; symbol display areas 100*d*, 100*e*, and 100*f* on reel 54*b*; symbol display areas 100*g*, 100*h*, and 100*i* on reel 54*c*; symbol display areas 100*j*, 100*k*, and 100*l* on reel 54*d*; and symbol display areas 100*m*, 100*n* and 100*o* on reel 54*e*. In addition to a scatter pay, the illustrated gaming device includes three paylines 52*a*, 52*b* and 52*c* associated with the reels. It should be appreciated that more or less paylines can be in the game. The illustrated gaming device also includes a plurality of symbols 102 which, in this example, are represented by the letters A 102*a*, B 102*b*, C 102*c*, D 102*d*, E 102*e*, F 102*f*, G 102*g*, H 102*h*, I 102*i*, J 102*j*, K 102*k*, L 102*l*, M 102*m*, N 102*n*, and O 102*o* displayed on the reels 54*a*, 54*b*, 54*c*, 54*d* and 54*e* in FIG. 3A. It should be appreciated that the gaming device can include any suitable number of symbols, and the symbols can include any suitable character, numeral, indicia, or image.

Figure 3A:
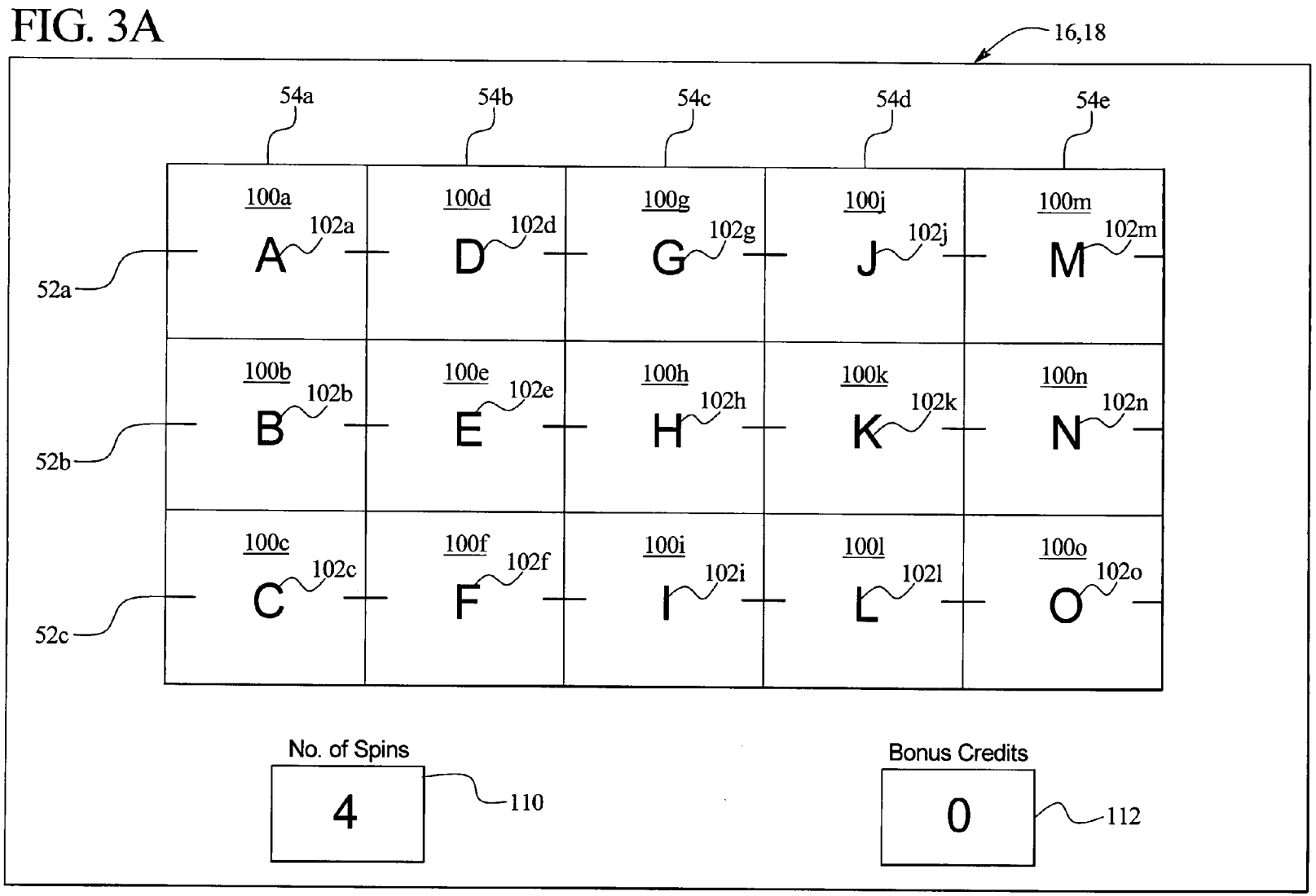
FIGS. 3A, 3B, 3C and 3D are front views of the display of one embodiment of the gaming device of the present invention.
Figure 3B:
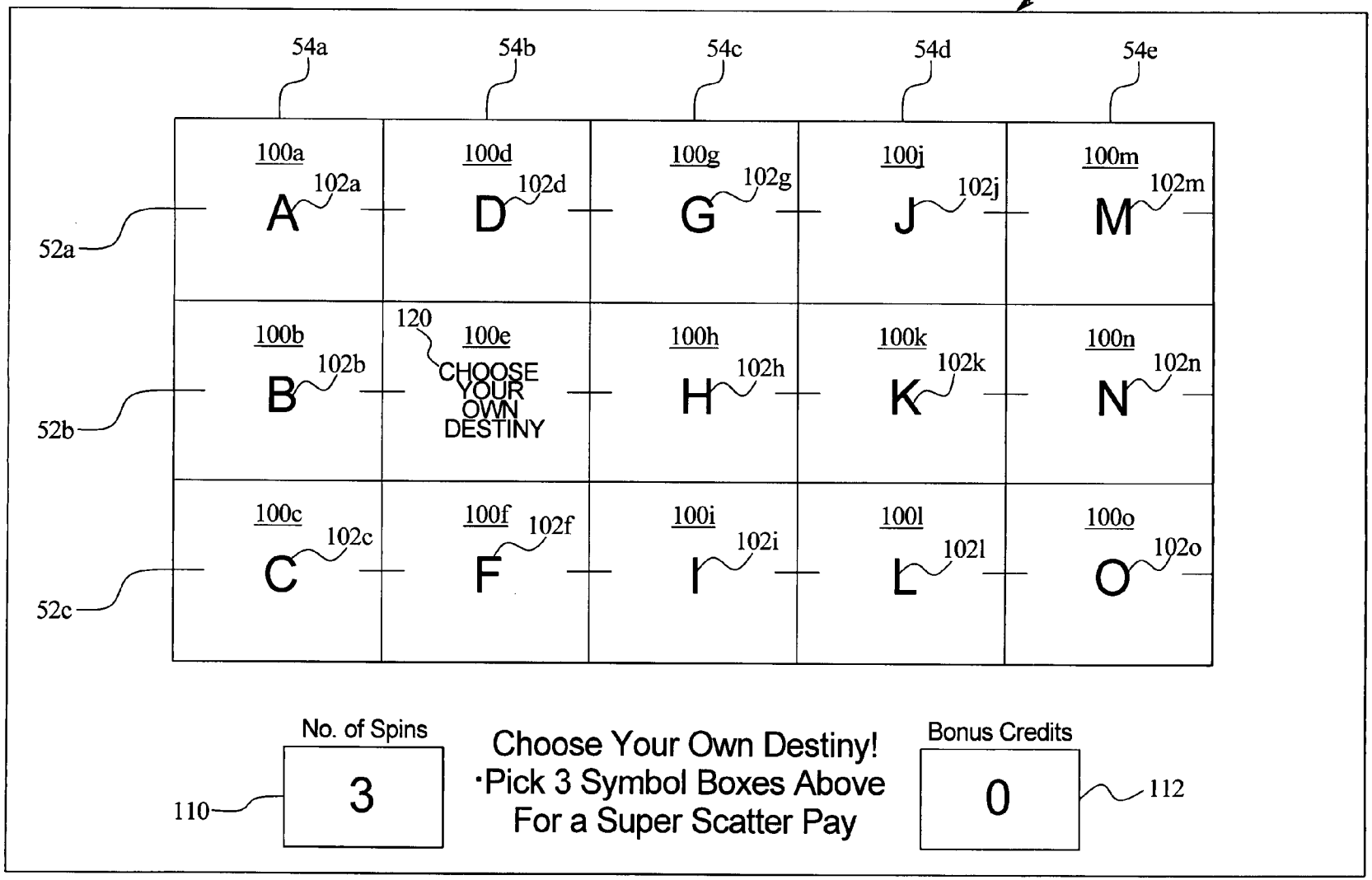

The game begins by activating the reels of FIG. 3A to display in FIG. 3B a plurality of the symbols. In one embodiment, the number of spins remaining display 110 is decreased by one indicating a single activation of the reels. In one embodiment, the gaming device performs an evaluation of the symbols for any winning combination of symbols generated along the activated paylines on the reels. In the embodiment illustrated in FIGS. 3B to 3D, a triggering symbol 120 initiates a prompt from the gaming device instructing the player to pick three symbol display areas on the display device 16. Alternatively, the symbol display areas are displayed on display device 18.

It should be appreciated that the gaming device can enable the player to pick different numbers of symbol display areas to form different scatter pays. In one embodiment, for example, the gaming device enables the player to select only one symbol display area from any reel. Also, the number of symbol display areas to be picked by the player can be based on different conditions of the game. In one embodiment, for example, the number of symbol display areas to be picked by the player is based on the amount of the wager made by the player. In another embodiment, the number of symbol display areas to be picked by the player is based on which trigger symbol is generated or the number of trigger symbols generated.

In one embodiment, the symbol display areas include alternative displays of the symbols such as symbol stacks, as described in U.S. Patent Application No. 2004/0023714. In such an embodiment, picking a symbol stack symbol display area having an initially displayed symbol and at least one initially hidden symbol reveals additional symbols to be evaluated in the scatter pay combination to increase the likelihood of winning.

Figure 3C:
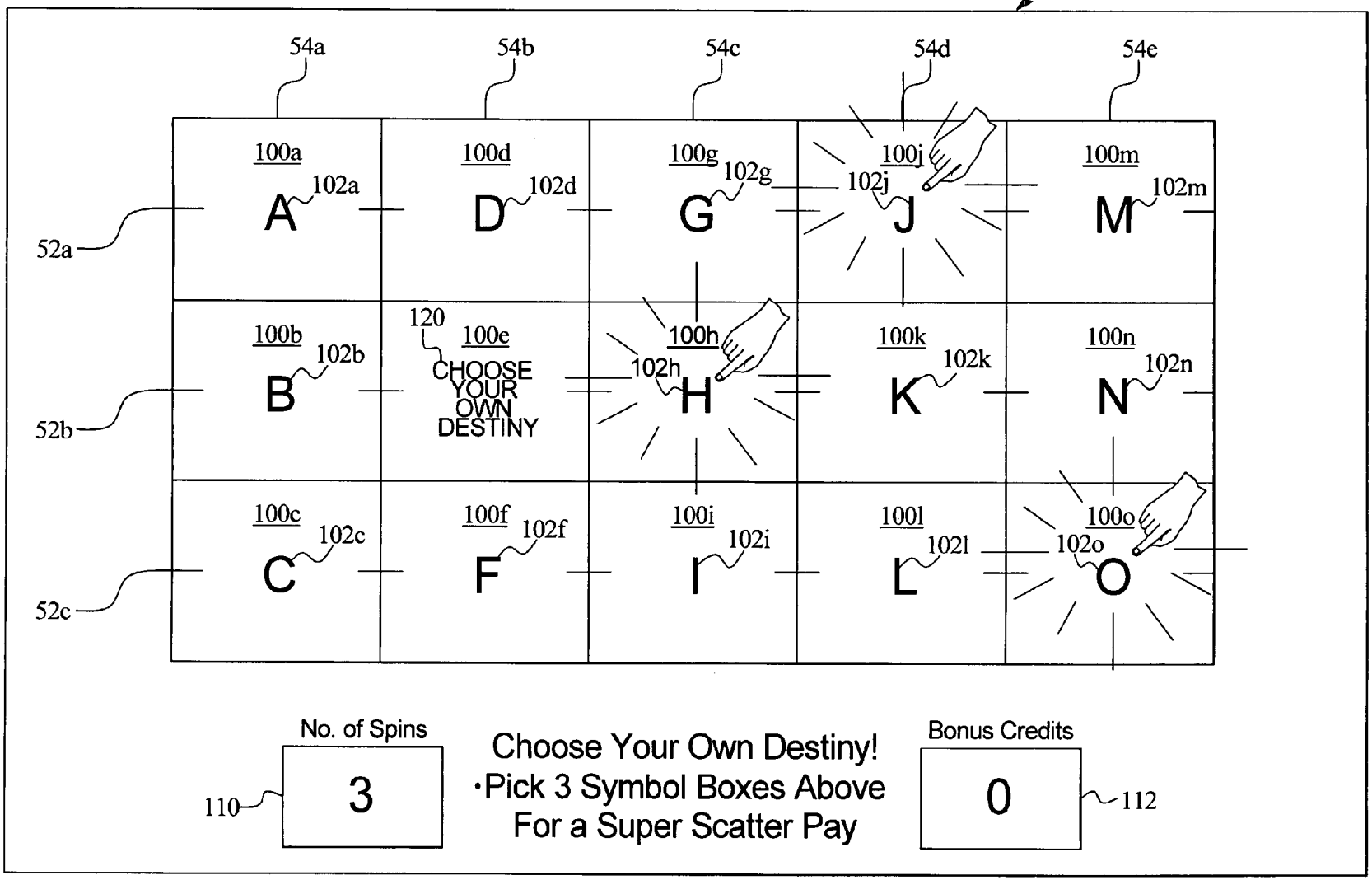

As illustrated in FIG. 3C, the player picks symbol display areas 100*h*, 100*j* and 100*o*. The symbol display areas 100*h*, 100*j* and 100*o* picked by the player form the scatter pay. Each of the picked symbol display areas are, in one embodiment, indicated or highlighted. The symbol display areas remain highlighted through at least one subsequent generation of symbols on the reels.

Figure 3D:
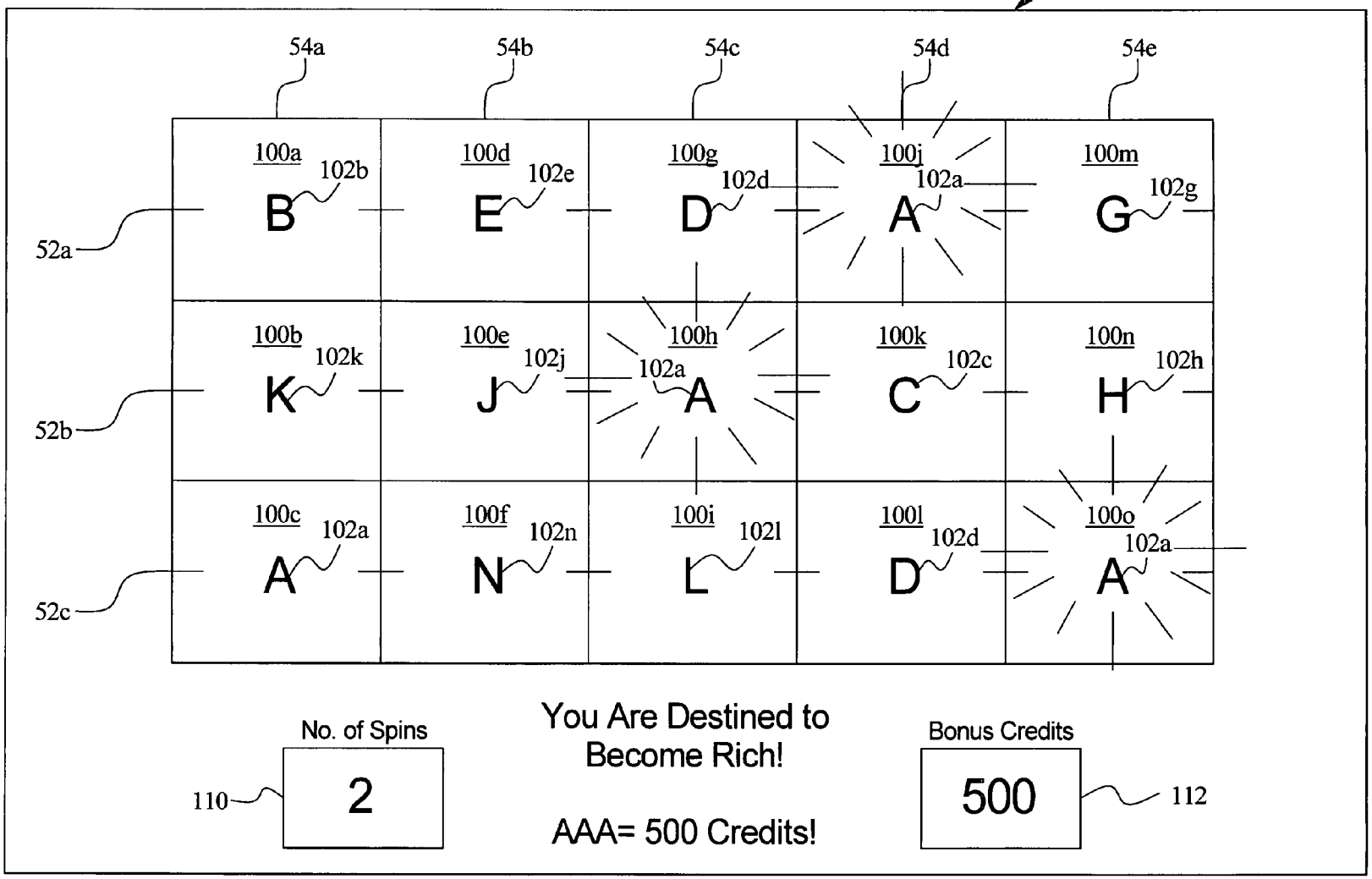

It should be appreciated that the present invention can be employed as a feature in a free spin game or as part of a free spin based on a triggering event in a game based on a wager. In FIG. 3D, the number of spins display 110 is decreased by one, indicating the activation of the reels and a decrease in the number of spins remaining to the player. Alternatively, the reels are automatically re-activated at least once upon selection of the symbol display areas and/or the player is provided at least one free spin of the reels in which the activation of the reels does not decrease the number of spins display 110. In one embodiment, the reels are re-activated automatically upon selection of the symbol display areas if a triggering symbol is generated on the last remaining spin.

The gaming device generates a combination of three A symbols 102*a* at the symbol display areas 100*h*, 100*j* and 100*o* picked by the player. The combination of symbols generated in the player selected scatter pay positions are evaluated for a winning combination corresponding to a paytable common to all paylines or, in one embodiment, a separate paytable for the scatter pay.

Figure 4A:
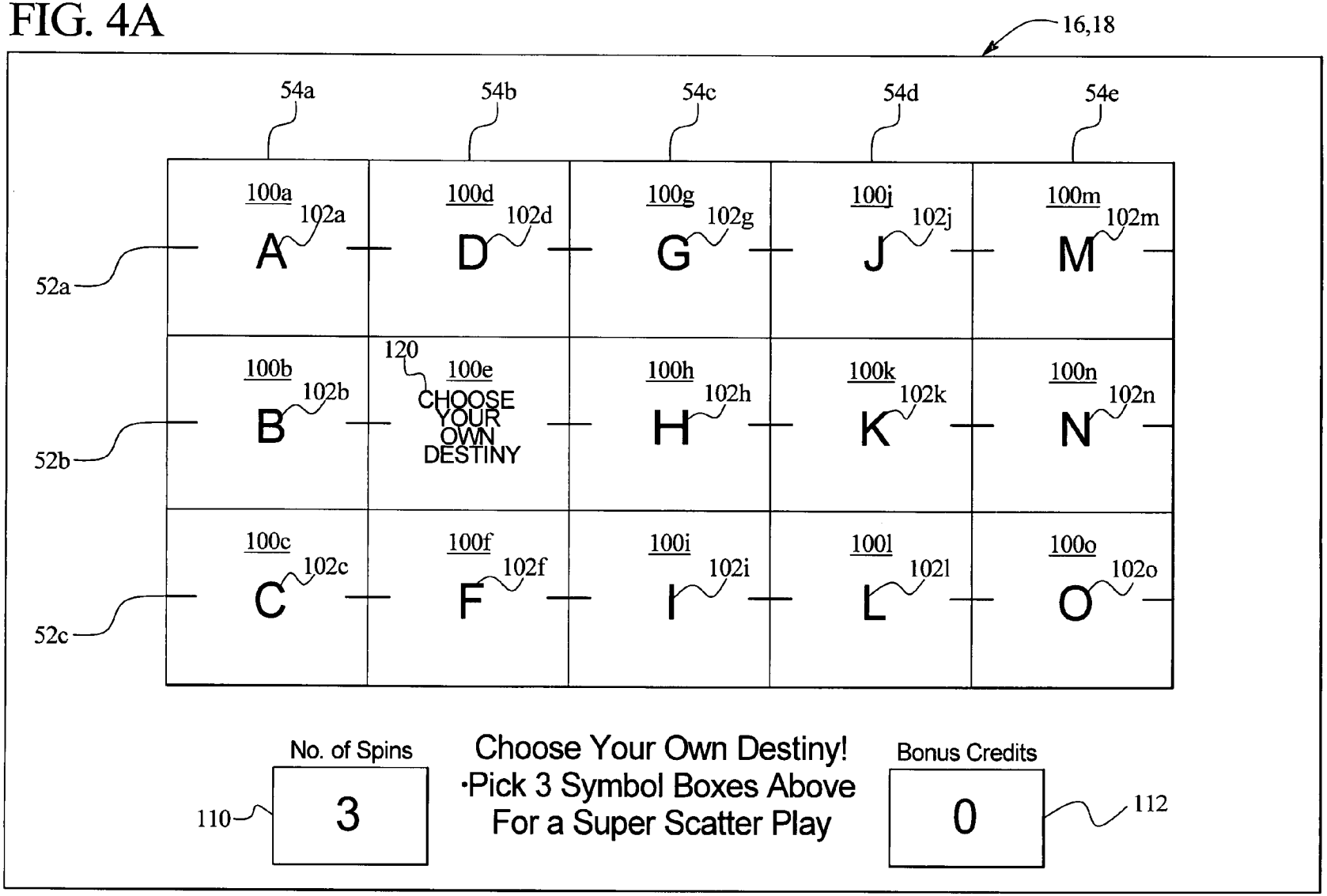
FIGS. 4A, 4B and 4C are front views of the display of one embodiment of the gaming device of the present invention.
Figure 4B:
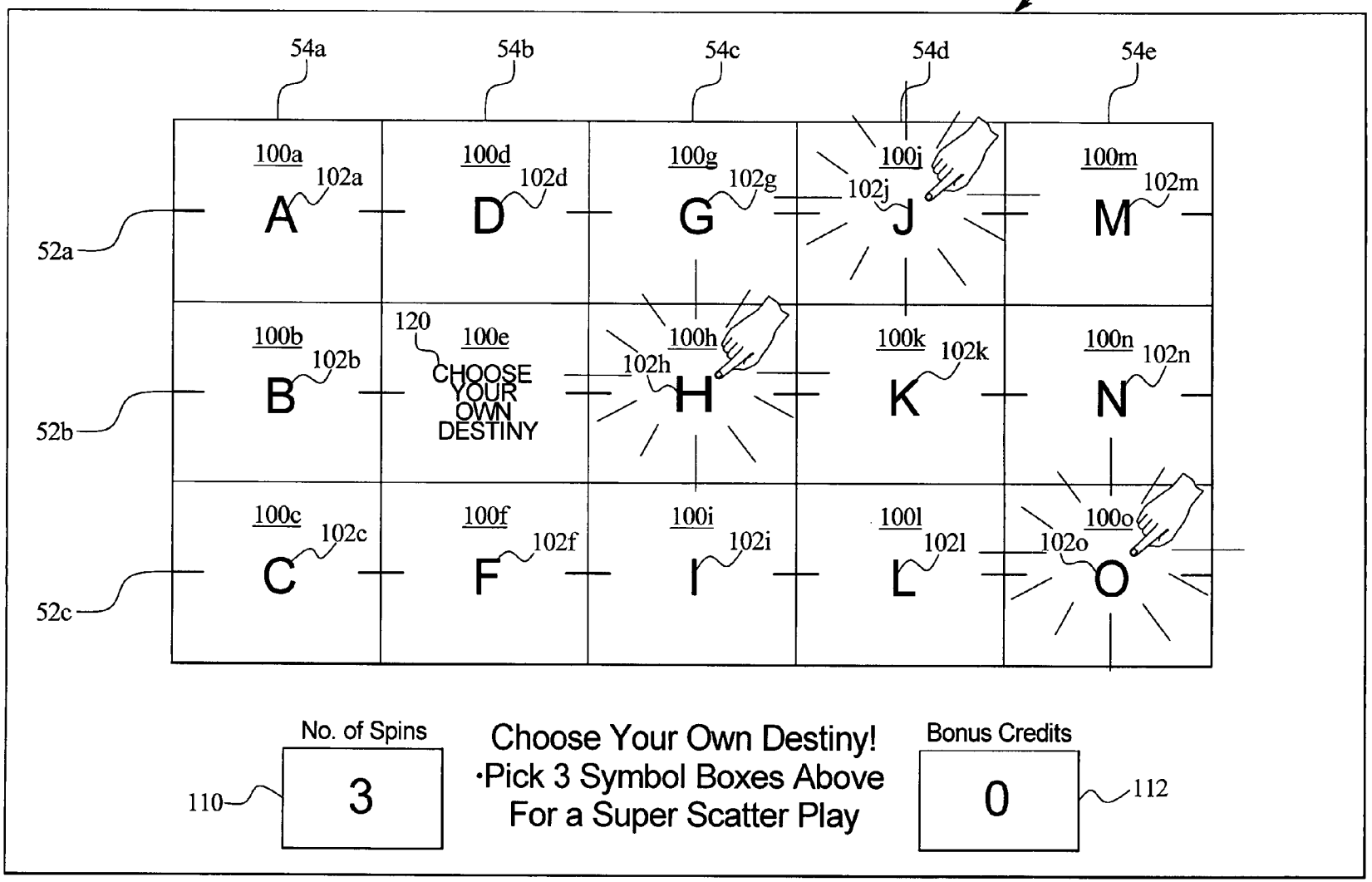
Figure 4C:
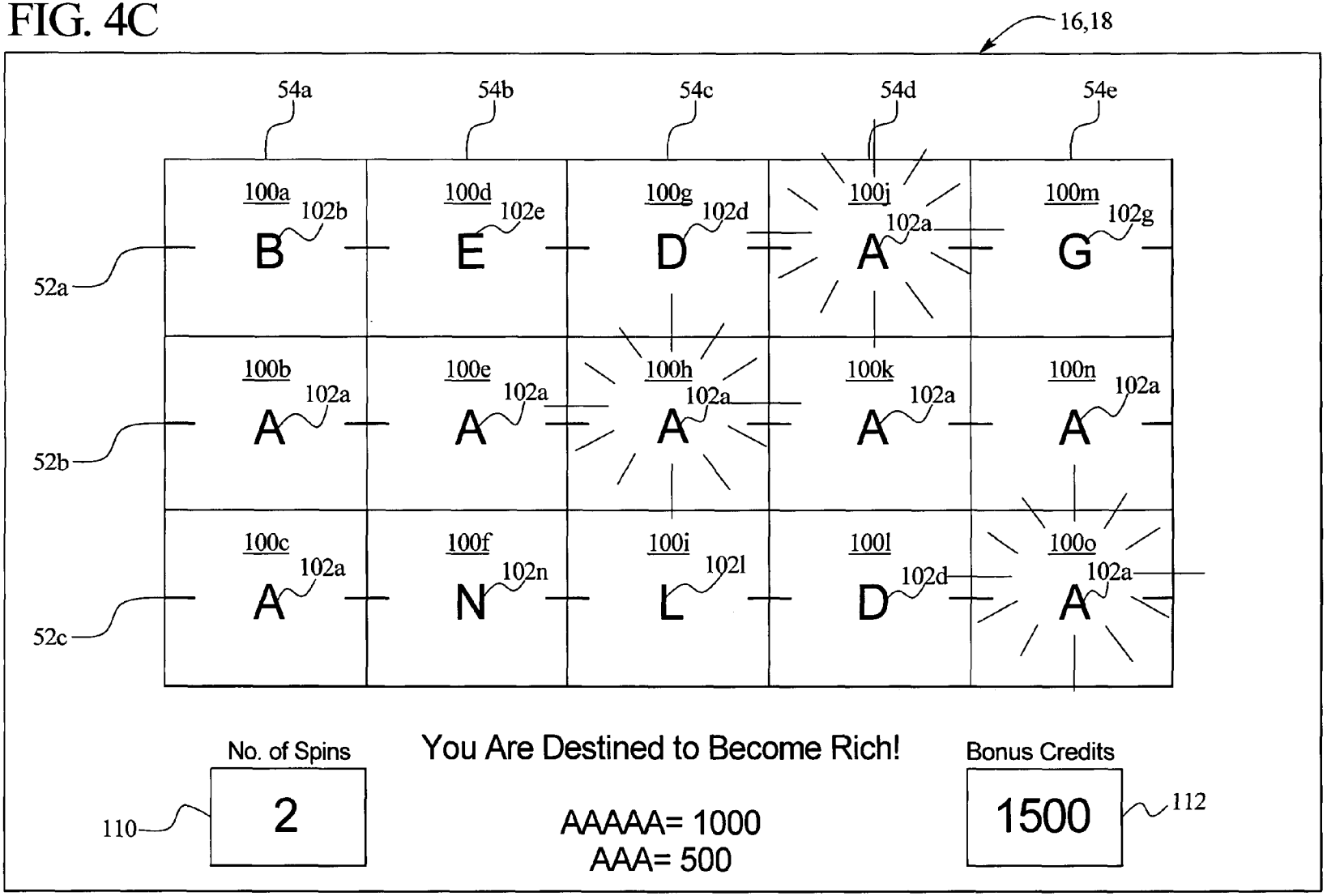

Referring to FIGS. 4A to 4C, in one embodiment of the gaming device of the present invention, the player may be eligible for more than one award if the gaming device generates winning combinations of symbols on more than one payline, including the payline formed by the symbol display areas picked by the player. Similar to FIGS. 3A to 3C, generation of a triggering symbol in FIG. 4B after the spinning of the reels in FIG. 4A, causes the gaming device to instruct the player to pick three of the symbol display areas to form a scatter pay. The player picks symbol display areas 100*h*, 100*j*, and 100*o*. As illustrated in FIGS. 4B and 4C, the three symbol display areas are highlighted upon selection by the player. The symbol display areas remain highlighted through at least the next spin of the reels. It should be appreciated that the spin can be one or more free spins, at least one spin paid for by the player, or combinations thereof. In addition, the gaming device generates five A symbols 102*a* along payline 52*b*.

In one embodiment, the gaming device provides the player any award associated with any winning combination of symbols whether the winning combinations are generated on the traditional paylines or the scatter pays. In this regard, the gaming device can provide the player more than one award for winning combinations of symbols generated along more than one active payline as illustrated in FIG. 4C.

In one embodiment, the gaming device includes more than one paytable for the game. In one embodiment, a different paytable is associated with each scatter pay. As illustrated in FIGS. 5A and 5B, in one embodiment, the gaming device of the present invention includes two separate paytables. In the illustrated embodiment, the paytable associated with the scatter pay illustrated in FIG. 5A is separate from the paytable illustrated in FIG. 5B associated with the paylines 52*a*, 52*b* and 52*c*. Therefore, whether a winning scatter pay combination is generated at the symbol display areas picked by the player is based on a paytable specifically associated with the scatter pay.

Referring back to FIGS. 3A to 3D and FIGS. 4A to 4D, according to the winning combinations of the scatter pay paytable displayed in FIG. 5A, the combination of three A symbols 102*a* generated at the symbol display areas 100*h*, 100*j*, and 100*o* picked by the player in FIGS. 3C and 4C is indicated in FIG. 5A as a winning combination corresponding to an award of five hundred credits. Likewise, the combination of five A symbols 102*a* generated along payline 52*b* in FIG. 4C is indicated in FIG. 5B as a winning combination corresponding to an award of one thousand. The awards are combined for a total of one thousand five hundred credits as indicated in the bonus credits display 112.

Figure 6A:
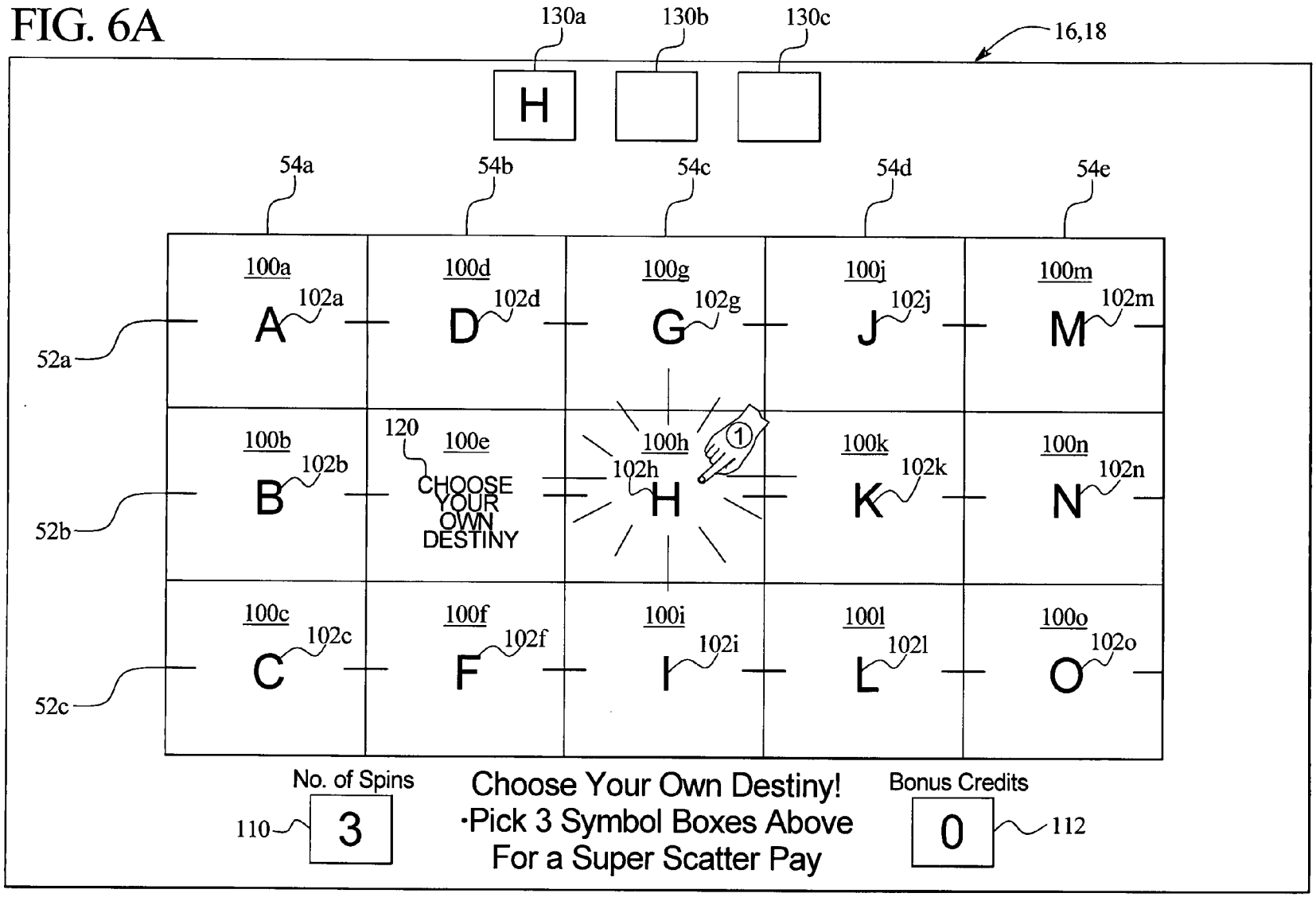
FIGS. 6A, 6B, 6C and 6D are front views of the display of one embodiment of the gaming device of the present invention.
Figure 6B:
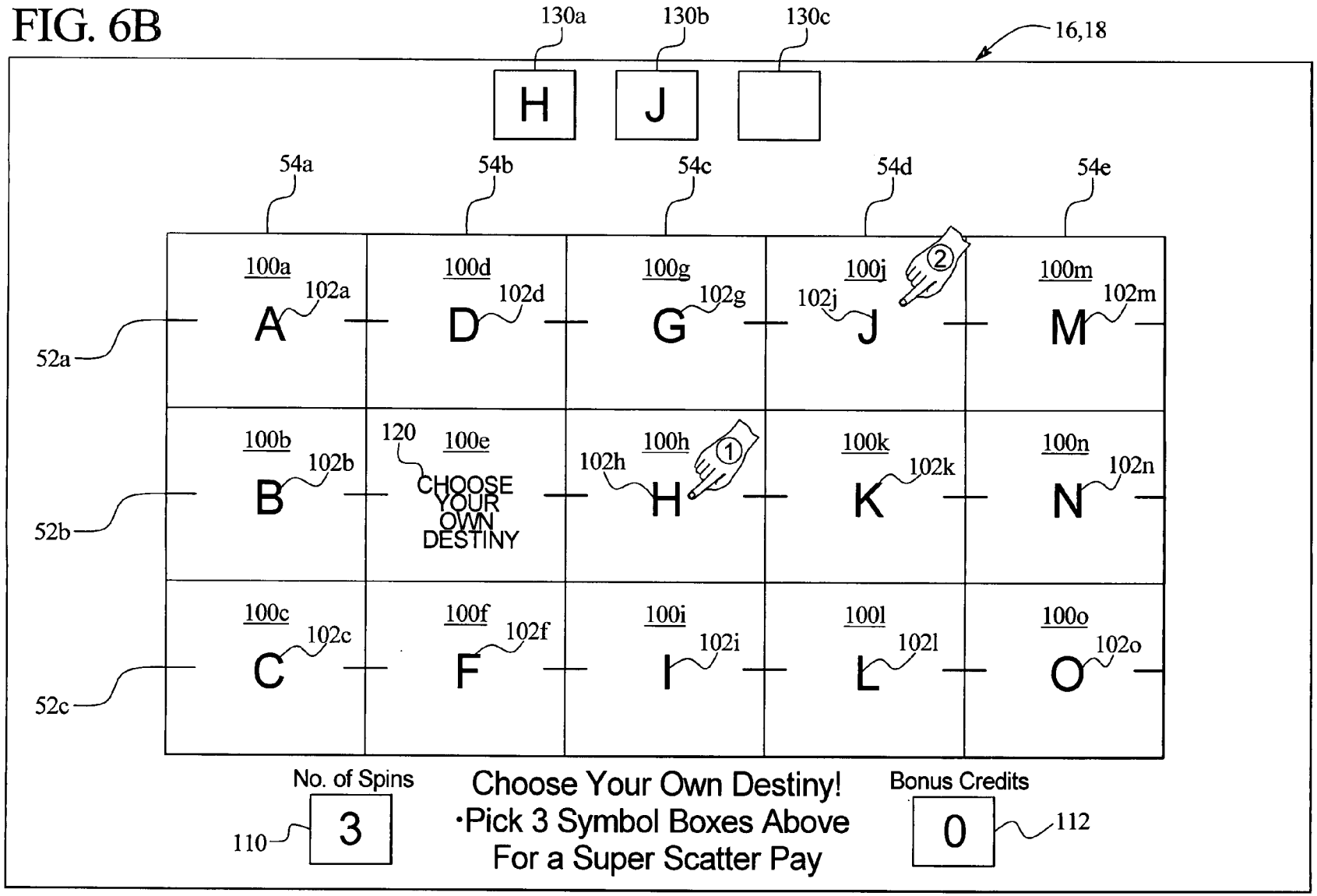
Figure 6C:
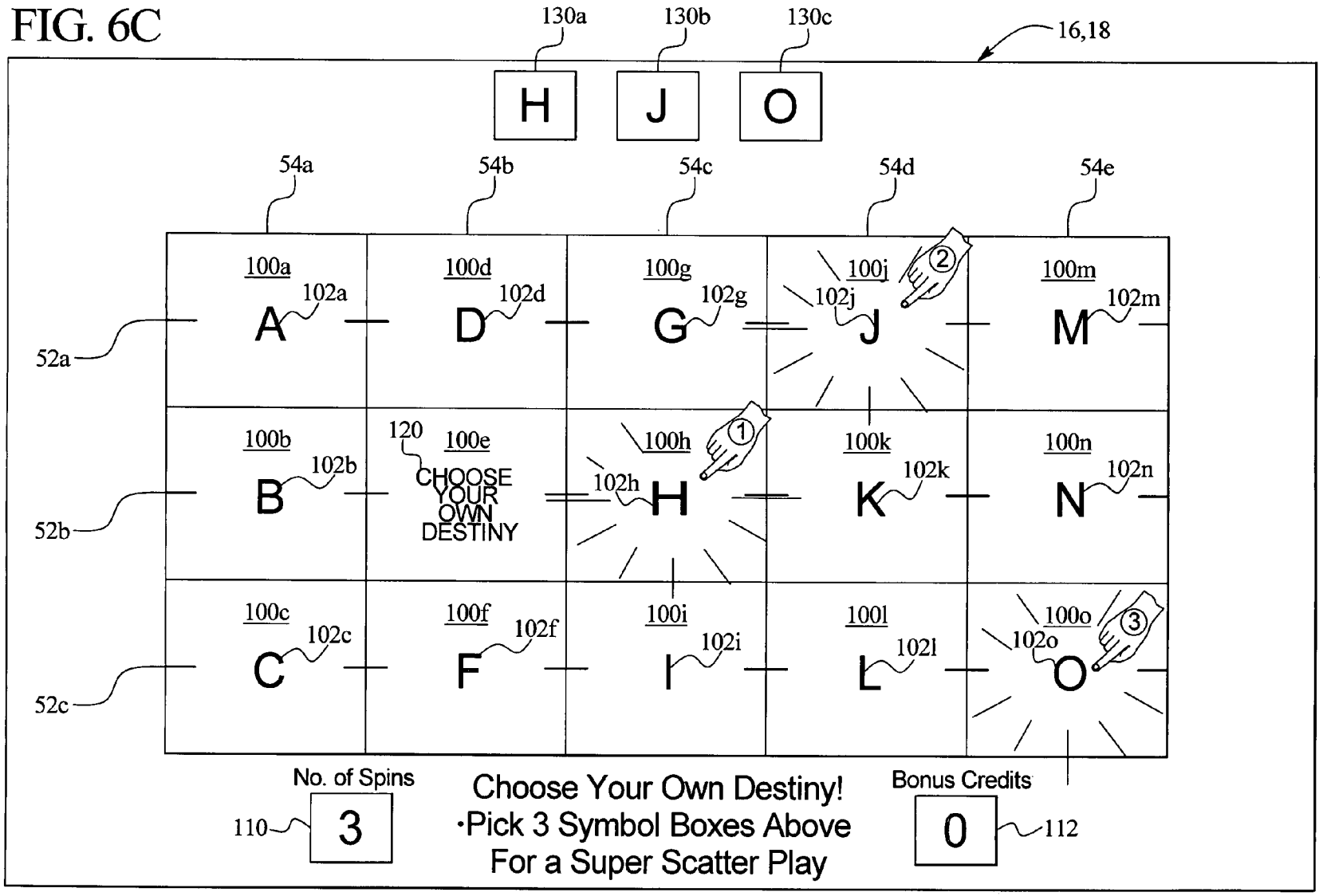
Figure 6D:
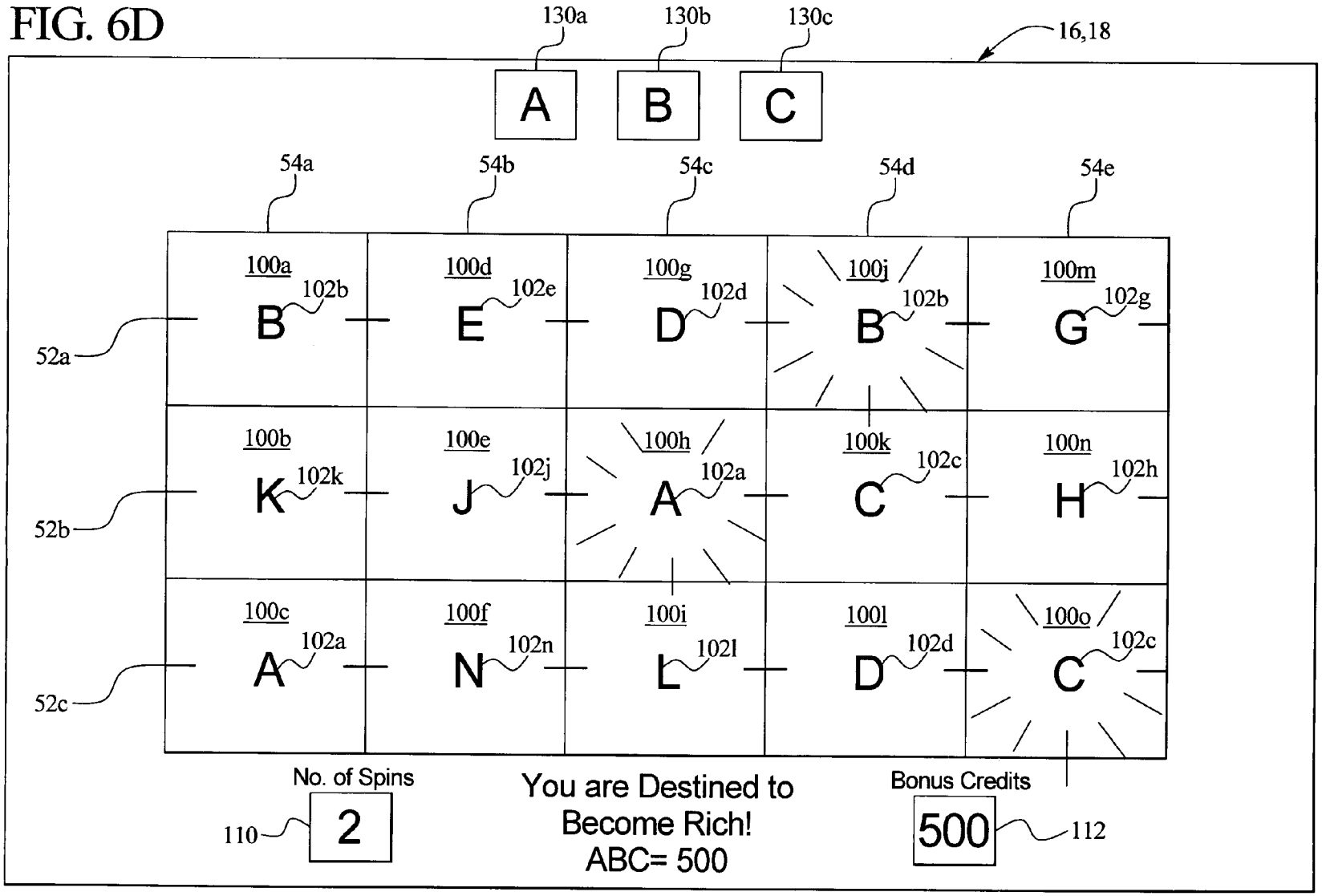

In one embodiment, the winning combination of symbols is determined according to an order in which the player picks the symbol display areas. For example, in FIGS. 6A to 6C, the player is prompted to pick three symbol display areas. The player picks symbol display area 100*h* first, 100*j* second, and 100*o* third. The order the symbol display areas are picked by the player are displayed in order display areas 130*a*, 130*b* and 130*c*. The order the symbol display areas are picked by the player sets the order in which the symbols generated in the symbol display areas are evaluated to determine a winning combination. As illustrated in FIG. 6D, the A symbol 102*a* is generated in symbol display area 100*h*, the B symbol 102*b* is generated in symbol display area 100*j* and the C symbol 102*c* is generated in symbol display area 100*o*. Because 100*h* was picked first, 100*j* second, and 100*o* third, the order the symbols generated in the symbol display areas of the scatter pay is A, B and C as displayed in order display areas 130*a*, 130*b* and 130*c*, respectively. According to the paytable illustrated in FIG. 7, an award of five hundred corresponds to the combination of "ABC", and the player is provided the award as indicated in the bonus credits display 112.

Figure 8A:
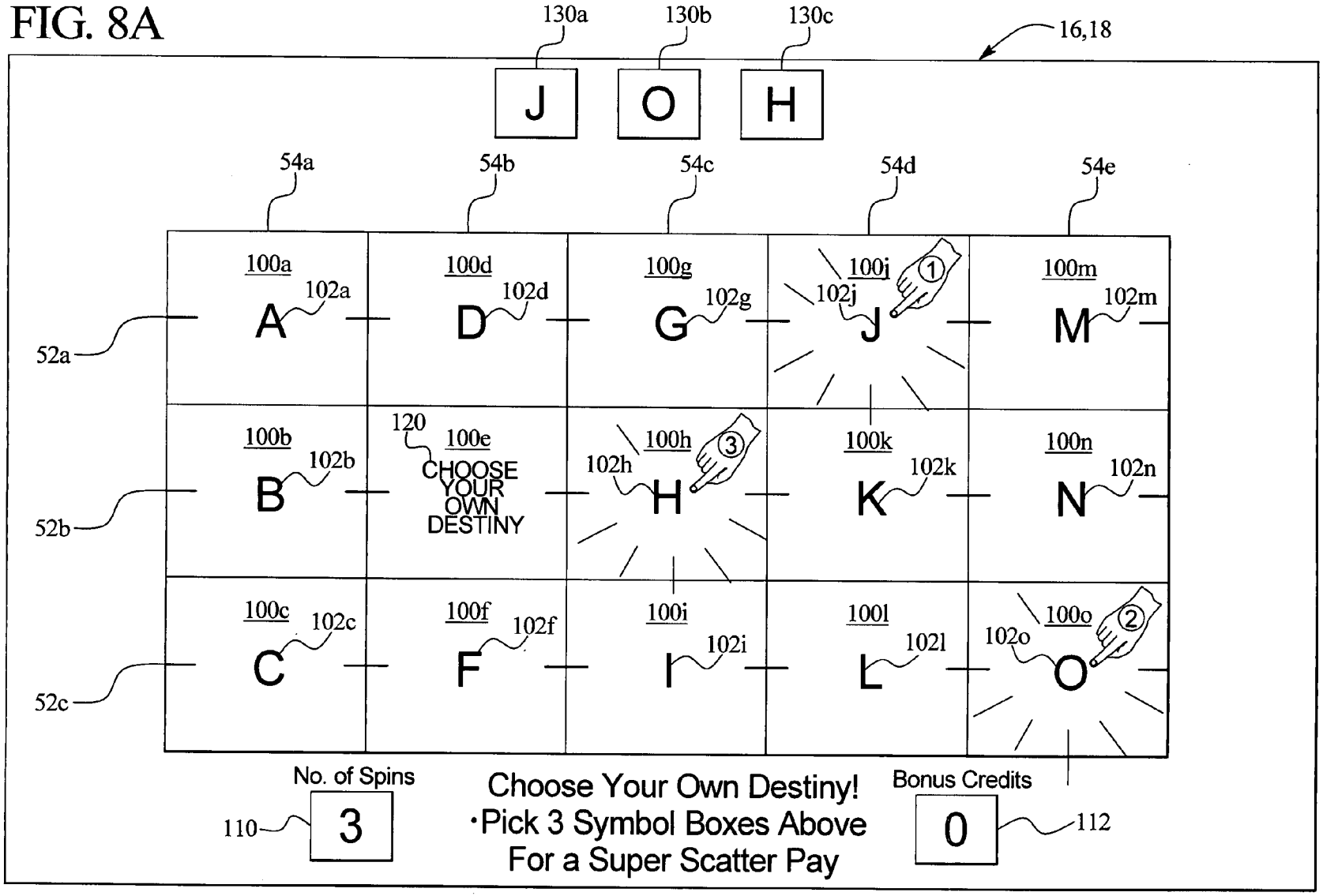
FIGS. 8A and 8B are front views of the display of one embodiment of the gaming device of the present invention.
Figure 8B:
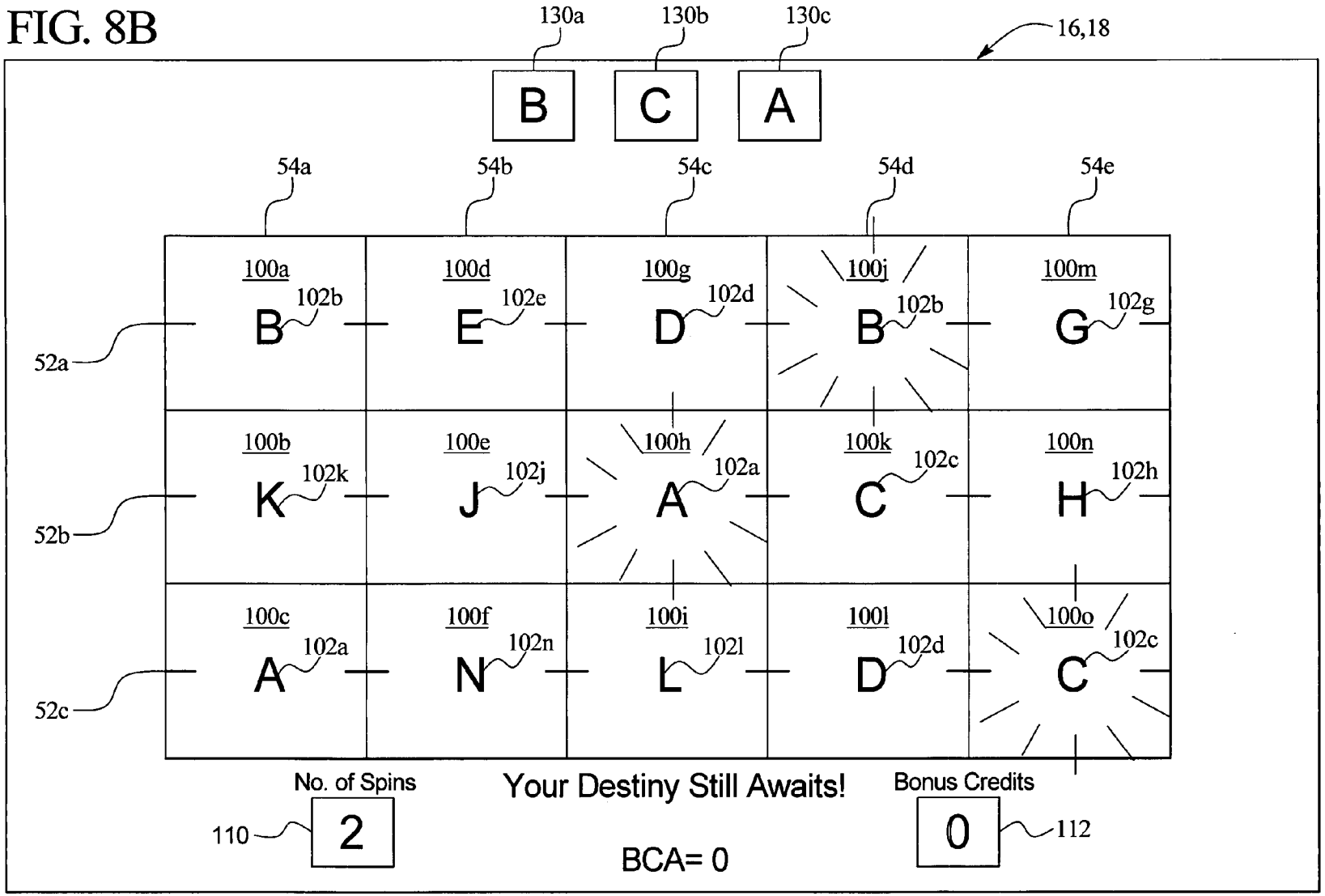

Referring now to FIGS. 8A and 8B, if the player picks another order other than 100*h* first, 100*j* second, and 100*o* third, such as 100*j* first, 100*o* second, and 100*h* third, the corresponding order of the symbols generated in those order display areas 130*a*, 130*b* and 130*c* is B, C and A, respectively. In this case, the gaming device does not provide the player an award because there is no award associated with the combination of "BCA" in the paytable of FIG. 7.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is claimed as follows:

1. A gaming device comprising:

at least one input device;

at least one display device;

at least one processor; and at least one memory device storing a plurality of instructions, which when executed by the at least one processor, cause the at least one processor to operate with the at least one input device and the at least one display device, for a single play of a game, to:

(i) accept a wager;

(ii) display a plurality of reels in said game, each of the plurality of reels being associated with a plurality of individual symbol display areas;

(iii) randomly determine a first set of symbols from a plurality of symbols of the reels and cause the reels to display said symbols of said first set of symbols at the plurality of symbol display areas associated with said reels;

(iv) determine if a predetermined condition occurred; and (v) when the predetermined condition occurs, (a) enable the player to pick a plurality of individual symbol display areas including at least one individual symbol display area associated with each of at least two, but not all, of the reels, (b) randomly determine a second different set of symbols from the plurality of symbols of the reels and after the player has picked the plurality of symbol display areas, cause the reels to display said symbols of the second different set of symbols at the symbol display areas associated with the reels including the individual symbol display areas picked by the player, and (c) for said randomly determined second different set of symbols:

(i) determine if at least one of a plurality of possible winning combinations of symbols is displayed at the symbol display areas picked by the player, wherein said determination is not based on whether the at least one winning combination of symbols is displayed at any payline, (ii) if any of the plurality of possible winning combinations of symbols are displayed at the symbol display areas picked by the player, for each winning combination, determine an award associated with said winning combination and provide said award to the player, and (iii) if any of the plurality of possible winning combinations of symbols are displayed at symbol display areas other than the symbol display areas picked by the player, not provide any award to the player for said winning combinations.

2. The gaming device of claim 1, wherein the predetermined condition is the generation of at least one trigger symbol of the plurality of symbols.

3. The gaming device of claim 1, wherein the predetermined condition is a placement of a wager of a predetermined amount.

4. The gaming device of claim 1, wherein the predetermined condition is the generation of a plurality of trigger symbols.

5. The gaming device of claim 4, wherein at least two of the plurality of trigger symbols are different from one another.

6. The gaming device of claim 1, wherein the, number of symbol display areas the player is enabled to pick is predetermined.

7. The gaming device of claim 1, wherein the plurality of instructions, when executed by the at least one processor, cause the at least one processor to determine the number of symbol display areas the player is enabled to pick based on the amount of the wager.

8. The gaming device of claim 1, wherein the plurality of instructions, when executed by the at least one processor, cause the at least one processor to determine the number of symbol display areas the player is enabled to pick based on the number of trigger symbols generated.

9. The gaming device of claim 1, wherein the plurality of instructions, when executed by the at least one processor, cause the at least one processor to determine the number of symbol display areas the player is enabled to pick based on a previous outcome in a game.

10. The gaming device of claim 1, wherein the plurality of instructions, when executed by the at least one processor, cause the at least one processor to activate the reels automatically upon the selection of the plurality of symbol display areas.

11. The gaming device of claim 1, wherein the plurality of instructions, when executed by the at least one processor, cause the at least one processor to generate and display subsequent sets of symbols at the symbol display areas a plurality of times, and display an award associated with any winning combinations of symbols displayed at the symbol display areas picked by the player for each subsequent generation of symbols.

12. The gaming device of claim 1, wherein a plurality of different awards are associated with the plurality of possible winning combinations of symbols.

13. The gaming device of claim 1, wherein the plurality of instructions, when executed by the at least one processor, cause the at least one processor to determine awards associated with winning combinations of the symbols based on a paytable.

14. The gaming device of claim 13, wherein the paytable is different from at least one other paytable, wherein said other paytable associates an award with other winning combinations.

15. The gaming device of claim 1, wherein the plurality of instructions, when executed by the at least one processor, cause the at least one processor to determine whether a winning combination of symbols is displayed at the symbol display areas based at least in part on the order in which the player picked the symbol display areas.

16. A method of operating a gaming device including at least one input device, at least one display device and at least one processor, said method comprising:

causing the at least one processor to randomly determine a first set of symbols from a plurality of symbols of a plurality of different reels, each of the plurality of reels being associated with a plurality of individual symbol display areas, and causing the at least one display device to display the symbols of the first set of symbols at the plurality of symbol display areas associated with the plurality of different reels;

enabling a player to pick a plurality of individual symbol display areas via the at least one input device including at least one individual symbol display area associated with each of at least two, but not all, of the reels;

causing the at least one processor to randomly determine a second different set of symbols of the plurality of symbols of the plurality of different reels and after the player has picked the plurality of symbol display areas, causing the at least one display device to display said symbols of the second different set of symbols at the plurality of symbol display areas associated with the plurality of different reels including the plurality of individual symbol display areas picked by the player; and for said randomly determined second different set of symbols:

(i) after displaying the second different set of symbols, determining if at least one of a plurality of possible winning combinations of symbols is displayed at the symbol display areas picked by the player, wherein said determination is not based on whether the at least one winning combination of symbols is displayed at any payline;

(ii) if any of the plurality of possible winning combinations of symbols are displayed at the symbol display areas picked by the player, for each winning combination, determining an award associated with said winning combination and providing said award to the player; and (iii) if any of the plurality of possible winning combinations of symbols are displayed at symbol display areas other than the symbol display areas picked by the player, not providing any award to the player for said winning combinations.

17. The method of claim 16, which includes enabling the player to pick a plurality of the symbol display areas if the player makes a wager equal to a predetermined amount in the game.

18. The method of claim 16, which includes enabling the player to pick a plurality of the symbol display areas upon a generation of at least one trigger symbol.

19. The method of claim 16, which includes enabling the player to pick a predetermined number of the symbol display areas.

20. The method of claim 16, which includes determining the number of symbol display areas to be picked by the player based on a generation of a trigger symbol.

21. The method of claim 16, which includes determining the number of symbol display areas to be picked by the player based on a generation of a plurality of trigger symbols.

22. The method of claim 16, which includes determining the number of symbol display areas to be picked by the player based on an amount of a wager.

23. The method of claim 16, which includes automatically activating the reels after picking the plurality of symbol display areas.

24. The method of claim 16, which includes generating and displaying a plurality of symbols at the symbol display areas a plurality of times after the player picks at least one of the symbol display areas and displaying an award associated with any winning combination of symbols displayed at the symbol display areas picked by the player for each of the plurality of symbol generations.

25. The method of claim 16, which includes determining a winning combination based on the order in which the player picks the symbol display areas.

26. The method of claim 16, which includes determining a winning combination based on a paytable associated with the symbols generated in the symbol display areas picked by the player.

27. The method of claim 26, wherein the paytable associated with the symbols generated at the symbol display areas picked by the player is different from at least one paytable associated with other symbol combinations in the game.

28. The method of claim 16, which is provided through a data network.

29. The method of claim 28, wherein the data network is an internet.

* * * * *

UNITED STATES PATENT AND TRADEMARK OFFICE

CERTIFICATE OF CORRECTION

PATENT NO. : 7,740,536 B2
APPLICATION NO. : 10/952589
DATED : June 22, 2010
INVENTOR(S) : Pederson et al.

It is certified that error appears in the above-identified patent and that said Letters Patent is hereby corrected as shown below:

IN THE CLAIMS:

Column 13, Line 28, replace "wherein the, number" with --wherein the number--.

Column 16, Line 2, replace "the order" with --an order--.

Signed and Sealed this

Twenty-first Day of September, 2010

David J. Kappos

David J. Kappos
*Director of the United States Patent and Trademark Office*